US011610567B1

(12) United States Patent
Maalouf

(10) Patent No.: US 11,610,567 B1
(45) Date of Patent: Mar. 21, 2023

(54) MUSICAL INSTRUMENT STAND SUPPORT APPARATUS WITH ROTATABLE ADJUSTMENT MECHANISM TO DISPLAY A GUITAR

(71) Applicant: Elie Maalouf, Burbank, CA (US)

(72) Inventor: Elie Maalouf, Burbank, CA (US)

( * ) Notice: Subject to any disclaimer, the term of this patent is extended or adjusted under 35 U.S.C. 154(b) by 0 days.

(21) Appl. No.: 17/582,918

(22) Filed: Jan. 24, 2022

Related U.S. Application Data

(63) Continuation-in-part of application No. 16/739,331, filed on Jan. 10, 2020, now Pat. No. 11,264,001.

(51) Int. Cl.
*G10G 5/00* (2006.01)
*G10D 3/00* (2020.01)

(52) U.S. Cl.
CPC ..... *G10G 5/00* (2013.01); *G10D 3/00* (2013.01)

(58) Field of Classification Search
CPC ..... G10G 5/00; G10D 3/00
See application file for complete search history.

(56) References Cited

U.S. PATENT DOCUMENTS 2,547,924 A * 4/1951 Citro ..... G10G 5/00 84/327
2,559,200 A * 7/1951 Schaf ..... G10G 5/00 84/267
4,159,092 A * 6/1979 DeLano ..... F16M 11/041 248/447.2
4,742,751 A * 5/1988 Cherry ..... G10G 5/00 84/421
5,121,890 A * 6/1992 Komada ..... G10G 5/00 248/167
5,202,527 A * 4/1993 Gracie ..... F16M 11/10 84/327
8,235,344 B1 * 8/2012 Bergin ..... G10G 5/00 248/346.06
9,230,524 B2 * 1/2016 Cortina ..... F16M 11/041
11,004,433 B1 * 5/2021 VanHaight ..... G10G 5/00
11,264,001 B1 * 3/2022 Maalouf ..... F16M 11/10
2005/0016354 A1 * 1/2005 Kent ..... F16M 11/28 84/327
2015/0129523 A1 * 5/2015 Cortina ..... F16B 2/10 211/85.6

* cited by examiner

*Primary Examiner* — Robert W Horn
(74) *Attorney, Agent, or Firm* — Plager Schack LLP; Mark H. Plager; Kara V. Verryt

(57) ABSTRACT

A musical instrument support apparatus for displaying a guitar in a plurality of viewing positions may include a securement frame configured to be rotatably mounted to a vertical surface and including a plurality of bars connected together; a pair of side arms pivotably mounted to the securement frame, each arm in the pair of side arms configured to pivotably adjust to contact the body of the guitar; and a wall mount bracket attached to the securement frame and configured to be attached to the vertical surface. The support apparatus may be designed to secure the guitar with the body disposed on the support plate and the pair of sides of the body secured within the pair of arms, wherein the securement frame is rotatably adjusted relative to the support base to display the secured guitar in one of the plurality of viewing positions.

7 Claims, 8 Drawing Sheets

MUSICAL INSTRUMENT STAND SUPPORT APPARATUS WITH ROTATABLE ADJUSTMENT MECHANISM TO DISPLAY A GUITAR

RELATED APPLICATION

This application claims priority to and is a continuation-in-part application of U.S. Ser. No. 16/739,331 filed on Jan. 10, 2020, the entire contents of which is herein incorporated by reference.

BACKGROUND

The embodiments herein relate generally to musical instrument stands. More specifically, embodiments of the invention are directed to a musical instrument stand with a rotatable adjustment mechanism to display a guitar in a desired position.

Guitars and bass guitars are musical instruments commonly used by musicians to produce music in a wide variety of genres. Several music enthusiasts own vintage guitars or other collector's guitars, which can commonly range in value anywhere up to at least several hundreds of thousands of dollars per guitar. These guitars are typically displayed on a stand to improve the aesthetics of a room and to allow individuals to appreciate the beauty of the instrument from different angles. Due to the high value and/or rarity of these vintage guitars and other collector's guitars, there is a need for a sturdy stand that will prominently display these instruments without inadvertently dropping or damaging the instrument.

There exists a variety of guitar stands as disclosed in U.S. Pat. Nos. 5,202,527, 4,742,751 and 2,547,924, which comprise a combination of bar members and fasteners to secure a guitar in a stationary position. These guitar stands are limited for one or more of the following reasons: (1) the stand has limited stability and is not desirable for use with vintage or collector's guitars; and/or (2) the stand limits the range of motion of the secured guitar, and thus may not display the guitar in the user's preferred position.

As such, there is a need in the industry for a musical instrument support stand apparatus with enhanced stability that addresses the limitations of the prior art, which provides a greater range of motion of the secured guitar. This provides the user greater flexibility in displaying the guitar in the desired position.

SUMMARY

Some embodiments of the present disclosure include a musical instrument support apparatus for displaying a guitar in a plurality of viewing positions. The support apparatus may include a securement frame configured to be rotatably mounted to a vertical surface and including a plurality of bars connected together; a pair of side arms pivotably mounted to the securement frame, each arm in the pair of side arms configured to pivotably adjust to contact the body of the guitar; and a wall mount bracket attached to the securement frame and configured to be attached to the vertical surface. The support apparatus may be designed to secure the guitar with the body disposed on the support plate and the pair of sides of the body secured within the pair of arms, wherein the securement frame is rotatably adjusted relative to the support base to display the secured guitar in one of the plurality of viewing positions.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
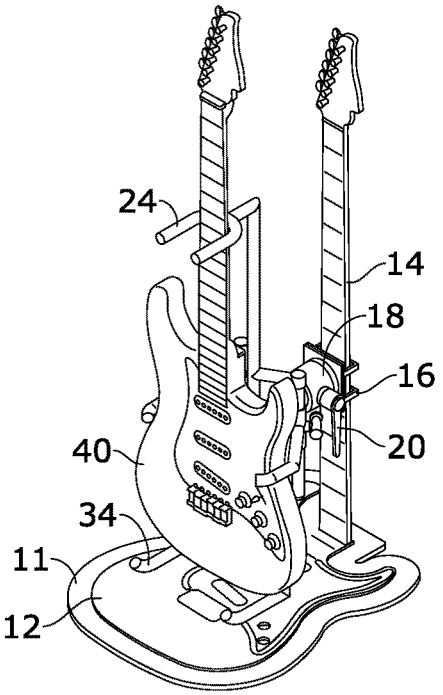
FIG. 1 depicts a perspective view of certain embodiments of the musical instrument stand support apparatus shown in use illustrating the guitar secured in an upright position.
Figure 2:
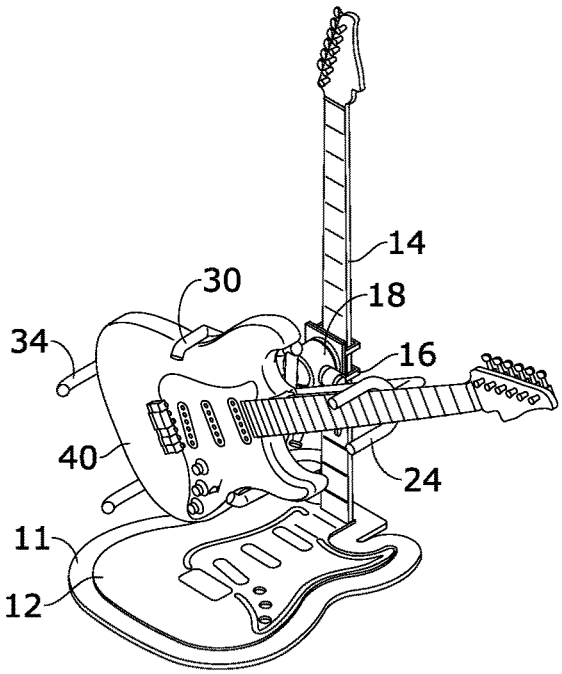
FIG. 2 depicts a perspective view of certain embodiments of the musical instrument stand support apparatus shown in use illustrating the guitar secured in an alternative position.
Figure 3:
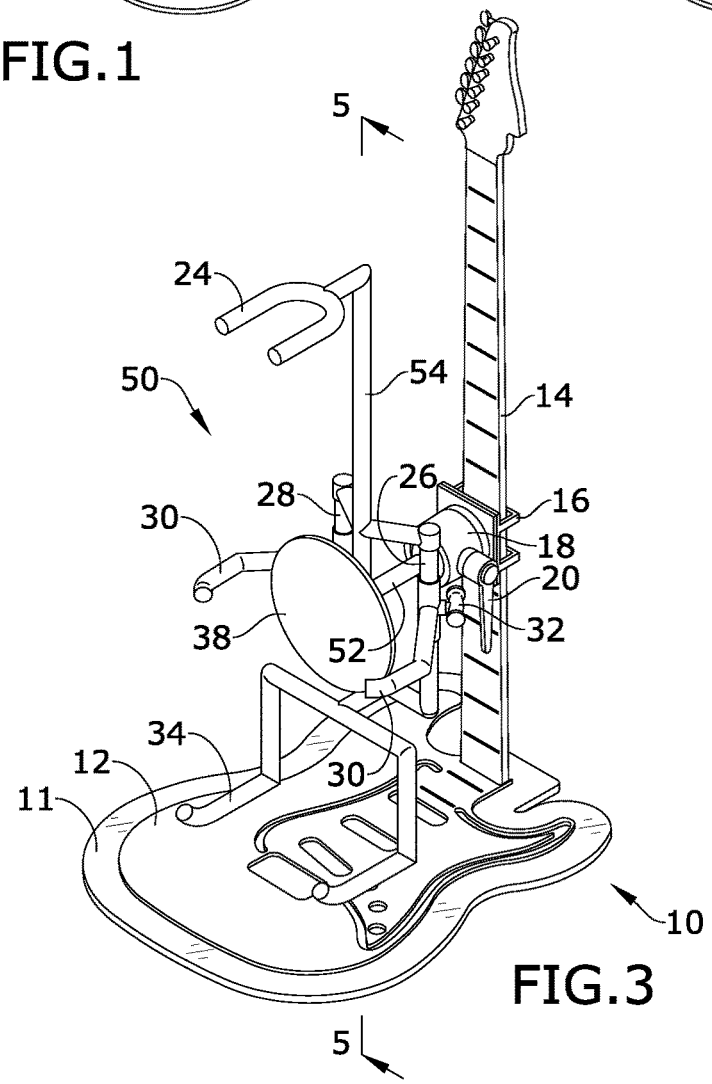
FIG. 3 depicts a perspective view of certain embodiments of the musical instrument stand support apparatus.

In certain embodiments of the invention as depicted in FIGS. 1-3, the musical instrument stand support apparatus comprises a stable platform that is configured to secure and display guitar 40 in one of a plurality of positions. Guitar 40 can be any type of guitar or base guitar known in the field having variable shapes and sizes. Although the figures depict the musical instrument stand support apparatus used with a guitar, it shall be appreciated that the apparatus can be used with any alternative musical instruments including, but not limited to, banjos, ukuleles, mandolins, fiddles or other instruments.

In one embodiment, the stand support apparatus generally comprises support base 10 and securement frame 50. The components of support base 10 and securement frame 50 are preferably made from 1018 cold-rolled steel, unless otherwise specified. In alternative embodiments, the components of support base 10 and securement frame 50 can be made from other types of steel, metals or materials.

Figure 7:
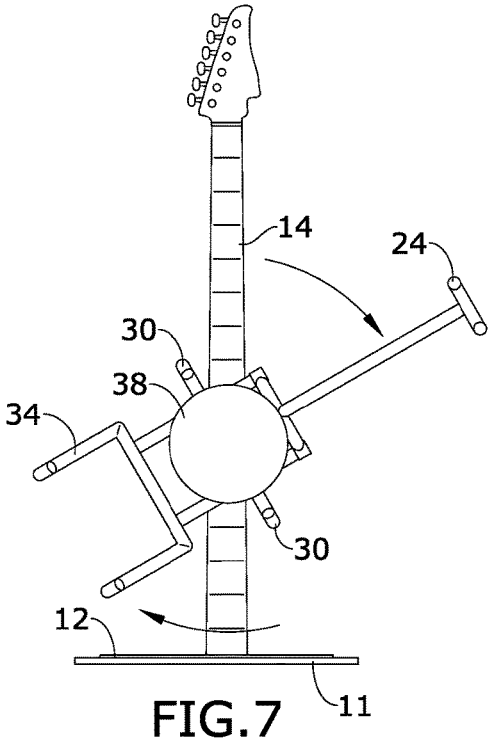
FIG. 7 depicts a front view of certain embodiments of the musical instrument stand support apparatus illustrating the rotation of securement frame 50.

As depicted in FIGS. 1-2 and 7, securement frame 50 is rotatably mounted to support base 10 and is configured to adjust to display guitar 40 in the plurality of viewing positions. Securement frame 50 is configured to rotate up to 360 degrees relative to support base 10.

Figure 4:
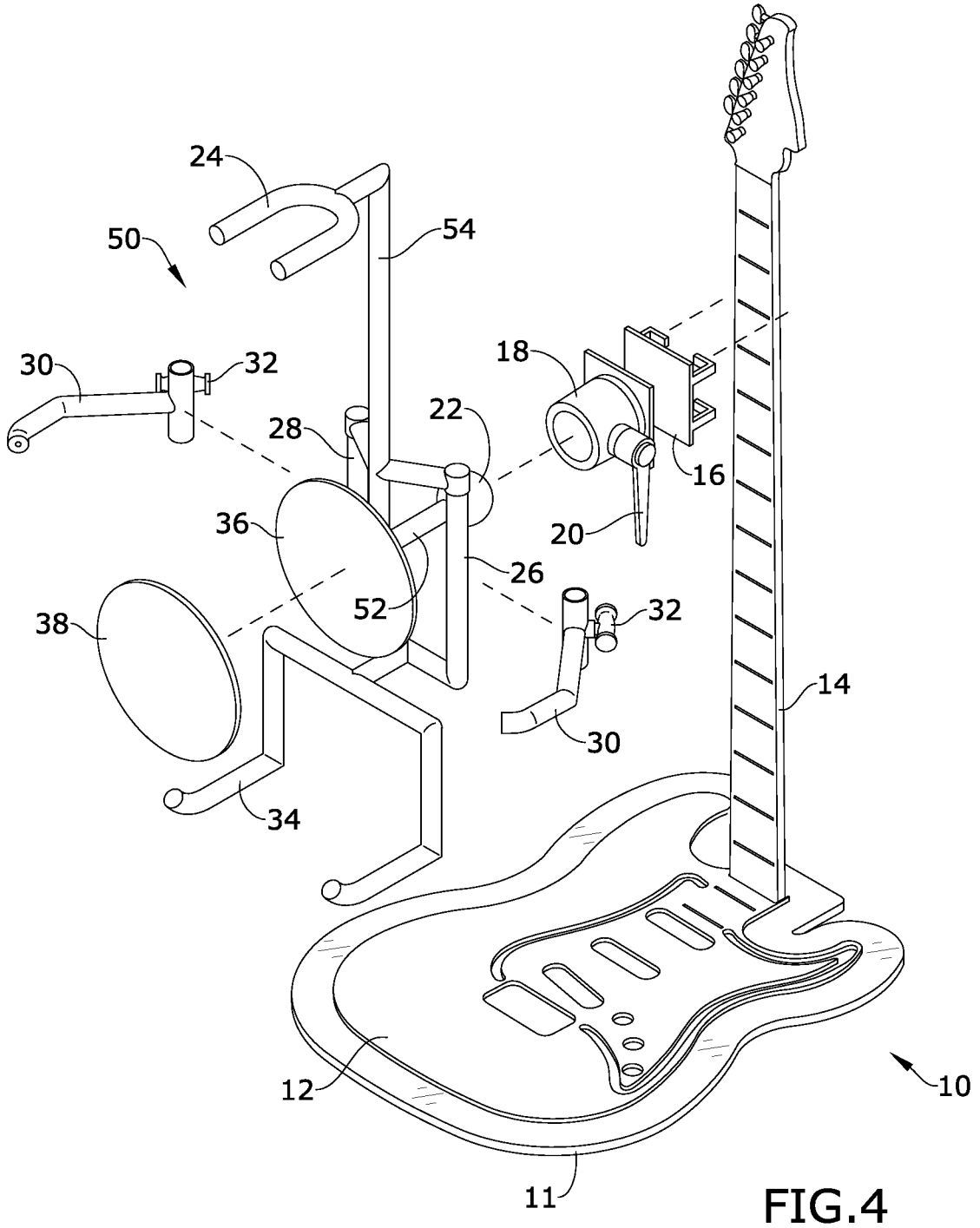
FIG. 4 depicts an exploded view of certain embodiments of the musical instrument stand support apparatus.

In one embodiment as depicted in FIGS. 3-4, support base 10 generally comprises acrylic base 11, base plate 12 and upright neck 14. Acrylic base 11 serves as the base platform of the stand support apparatus and is disposed on the ground. In one embodiment, one or more strings of LED lights or alternative illuminating devices are coupled to acrylic base 11 to enhance aesthetics of the stand support apparatus. In one embodiment, acrylic base 11 is made from Plexiglas. However, acrylic base 11 can be made from alternative materials and have various shapes, colors, markings, designs, logos and the like. In a preferred embodiment, acrylic base 11 comprises an outer shape that resembles a guitar body.

In one embodiment as depicted in FIGS. 3-4, base plate 12 of support base 10 is coupled to the top of acrylic base 11 by mechanical fasteners. In one embodiment, the bottom of base plate 12 comprises a plurality of bolts welded thereon that fastens base plate 12 to acrylic base 11. In an alternative embodiment, other fastening components can be used to secure base plate 12 to acrylic base 11. Base plate 12 can have variable shapes, colors, designs, markings, logos and the like. In a preferred embodiment, base plate 12 comprises a member having the size and shape of a guitar body.

In one embodiment as depicted in FIGS. 3-4, upright neck 14 comprises the shape and design of a guitar neck. Upright neck 14 comprises a first end that is welded or mechanically fastened to base plate 12. In a preferred embodiment, upright neck 14 extends vertically from base plate 12 and serves as a mounting location for securement frame 50. In one embodiment, additional reinforcement bars can be used to enhance the connection strength of upper neck 14 to base plate 12.

Figure 5:
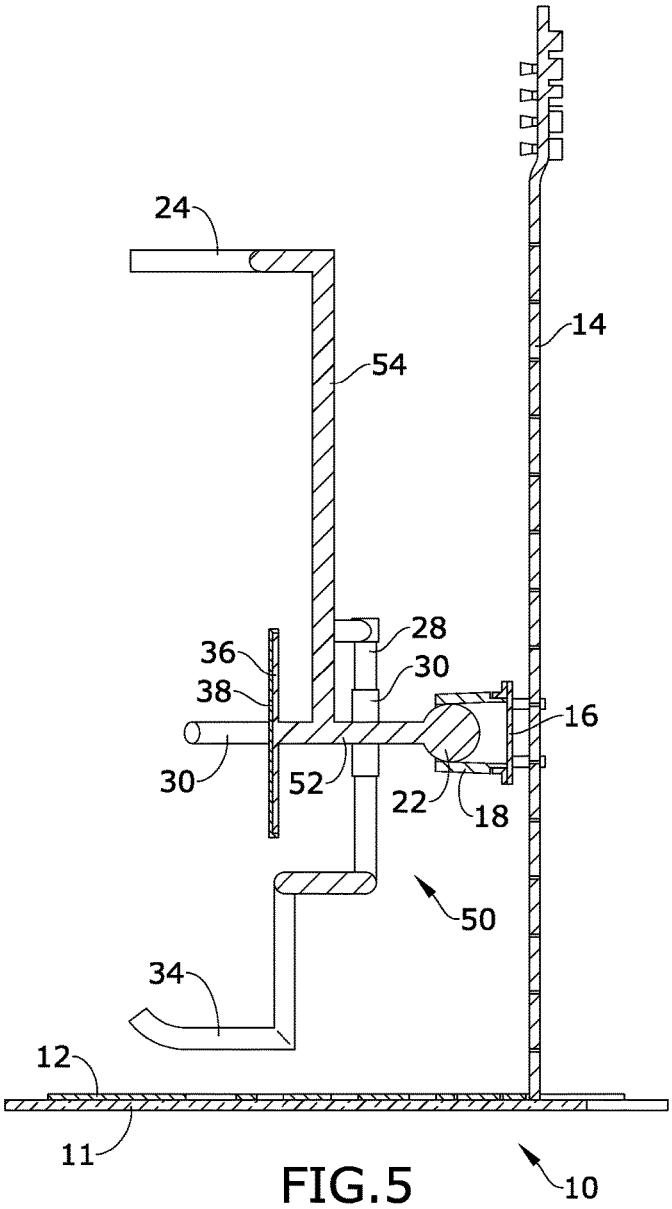
FIG. 5 depicts a section view of certain embodiments of the musical instrument stand support apparatus, taken along line 5-5 in FIG. 3.
Figure 6:
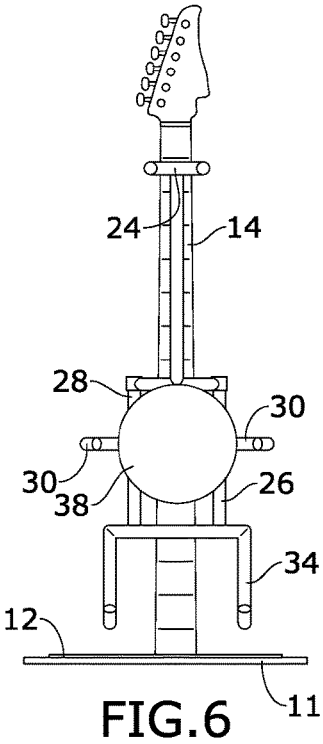
FIG. 6 depicts a front view of certain embodiments of the musical instrument stand support apparatus.

In certain embodiments as depicted in FIGS. 3-7, securement frame 50 is rotatably mounted to upright neck 14 of support base 10 by neck attachment 16 and swivel flange 18. Neck attachment 16 comprises a steel clamp member that is preferably welded to upright neck 14 of support base 10. In an alternative embodiment, mechanical fasteners or other fastening components can be used to couple neck attachment 16 to upright neck 14. In one embodiment as depicted in FIGS. 4-5, swivel flange 18 comprises a tubular member connected to a back plate. The back plate of swivel flange 18 is coupled to neck attachment 16 by four bolts.

In an alternative embodiment, any alternate number of bolts can be used to fasten swivel flange 18 to neck attachment 16. It shall be appreciated that other mechanical components or fastening components can also be used instead in alternative embodiments to fasten swivel flange 18 to neck attachment 16.

In certain embodiments as depicted in FIGS. 3-5, securement frame 50 comprises a plurality of bars connected together including at least horizontal bar 52, vertical bar 54, first side frame bar 26 and second side frame bar 28, upper cradle 24, a pair of side arms 30 and bottom cradle 34. It shall be appreciated that the components of securement frame 50 can be welded together or fastened together using any fastening components known in the field.

In a preferred embodiment, horizontal bar 52 is continuously connected to vertical bar 54. However, horizontal bar 52 and vertical bar 54 can be separate bars connected together in an alternative embodiment. In one embodiment, horizontal bar 52 comprises a first end having spherical member 22 and a second end having support plate 36. As depicted in FIGS. 4-5, spherical member 22 is disposed within the tubular member of swivel flange 18.

In one embodiment, lock handle 20 is operably connected to swivel flange 18 and is configured to communicate with spherical member 22 of horizontal bar 52. In certain embodiments, lock handle 20 is configured to maneuver to an unlocked position to disengage with spherical member 22, thereby enabling rotatable movement of spherical member 22 and securement frame 50 relative to swivel flange 18. Lock handle 20 is configured to maneuver to a locked position to engage with spherical member 22, thereby preventing rotatable movement of spherical member 22 and securement frame 50 relative to swivel flange 18.

In certain embodiments as depicted in FIGS. 1-2 and 4-5, upper cradle 24 is coupled to the top end of vertical bar 54 and is configured to receive the neck of guitar 40. In a preferred embodiment, upper cradle 24 comprises a U-shaped member with a pair of prongs that extends on opposing sides of the neck of guitar 40 as depicted in FIGS. 1-2. However, the shape of upper cradle 24 can vary in alternative embodiments.

In one embodiment as depicted in FIGS. 1-4, first and second side frame bars 26, 28 are coupled to vertical bar 54 by connecting members. Each side frame bar 26, 28 serves as a mounting location for one of the pair of side arms 30. Each side frame bar 26, 28 comprises an end tubular member that is disposed around first side frame bar 26 or second side frame bar 28. This connection allows first and second side arms 30 to pivot on first and second side frame bars 26, 28.

In one embodiment, set screw 32 is coupled to the tubular member connected to each side arm 30. Set screw 32 is configured to adjust to disengage from first side frame bar 26 or second side frame bar 28. This allows side arm 30 to pivot on side frame bar 26, 28. Alternatively, set screw 32 is configured to adjust to engage with first side frame bar 26 or second side frame bar 28. This locks side arm 30 in place, thereby preventing pivotal movement of side arm 30 on side frame bar 26, 28.

In one embodiment as depicted in FIGS. 1-5, lower cradle 34 is coupled to vertical bar 54 and comprises a pair of L-shaped members. The L-shaped members of lower cradle 34 are configured to contact and support the bottom of the body of guitar 40.

In one embodiment as depicted in FIG. 4, pad 38 is coupled to support plate 36 and comprises a material such as leather, rubber or other resilient and/or deformable material. In one embodiment, a padding material is disposed around upper cradle 24, the pair of side arms 30, bottom cradle 34, and any other location on the stand support apparatus that contacts guitar 40. The padding material comprises a material such as leather, rubber or other resilient and/or deformable material.

In operation, guitar 40 is secured to the stand support apparatus. In one embodiment as depicted in FIG. 1, guitar 40 is maneuvered so that the body is disposed against pad 38 and support plate 36, the bottom of the guitar body is disposed on lower cradle 34, and the neck of guitar 40 is disposed in upper cradle 24. The pair of side arms 30 are pivotably adjusted and locked in place to contact the sides of the body of guitar 40.

In this position, guitar 40 is securely fastened within upper cradle 24, side arms 30 and lower cradle 34 of securement frame 50 of the stand support apparatus. Lock handle 20 can be unlocked to permit securement frame 50 and guitar 40 to rotate up to 360 degrees relative to upright neck 14 of support base 10 as depicted in FIG. 7. Lock handle 20 is maneuvered to retain guitar 40 in the desired locking position. Since guitar 40 is securely fastened to securement frame 50, guitar 40 will not detach from the stand support apparatus in any displayed position.

In an alternative embodiment, it shall be appreciated that the pair of side arms 30 can be pivotably mounted to any other locations on securement frame 50. This allows side arms 30 to pivotably adjust to contact any alternative locations on the body of guitar 40. This is beneficial because it allows the stand support apparatus to accommodate different types of guitars and other musical instruments.

As shown in FIGS. 8-15, an alternative embodiment of the music stand of the present disclosure comprises wall-mounted support apparatus that is configured to secure and display guitar 40 in one of a plurality of positions. Similar to above, although the figures depict the musical instrument stand support apparatus used with a guitar, it shall be appreciated that the apparatus can be used with any alternative musical instruments including, but not limited to, banjos, ukuleles, mandolins, fiddles or other instruments.

In embodiments, the wall-mounted support apparatus generally comprises a securement frame configured to operatively attach to a wall 102 or other upright surface, wherein the securement frame is configured to secure and display the guitar 40 and may be configured to adjust to display guitar 40 in a plurality of viewing positions. In embodiments, the securement frame may be configured to rotate up to 360 degrees relative to the wall 102.

In embodiments, and as shown in FIGS. 8-15, the securement frame may comprise a plurality of bars connected together including at least horizontal J-arm 72, vertical J-arm 78, a U-arm 80, a pair of side bar arms 90, and a lower cradle 84. It shall be appreciated that the components of the securement frame may be welded together or fastened together using any fastening components known in the field.

In embodiments, the horizontal J-arm 72 may be substantially elongate with a curved or hooked distal end. A proximal end of the horizontal J-arm 72 may be operatively and rotatable engaged with the vertical J-arm 78. For example, the vertical J-arm 78 may include a proximal end with a J-arm coupler 74 fixedly mounted thereto, wherein the J-arm coupler 74 is substantially cylindrical and sized to accommodate insertion of the proximal end of the horizontal J-arm 72 therein such that the proximal end of the horizontal J-arm 72 is permitted to rotate within the J-arm coupler 74, allowing the securement frame to rotate with respect to the wall 102. A collar 68 may be operatively connected, such as with a collar set screw 70, to an edge of the J-arm coupler 74 opposite the horizontal J-arm 72. As shown in the Figures, the J-arm coupler 74 may have a threaded orifice extending therethrough, wherein the threaded orifices are sized to accommodate insertion of a threaded end of a thumb screw 66 therein, wherein the thumb screw 66 may be tightened to place pressure onto the proximal end of the horizontal J-arm 72, securing the securement frame at the desired viewing position with respect to the wall 102. In some embodiments, a nut 76 may also be used in conjunction with the thumb screw 66.

As shown in the Figures, the vertical J-arm 78 may comprise a substantially elongate bar with the J-arm coupler 74 attached to a proximal end thereof. The distal end of the vertical J-arm 78 may comprise a hook or a curve, wherein the lower cradle 84 may be attached to the distal end of the vertical J-arm 78. An upright pad support 82 may also extend upward from the distal end of the vertical J-arm 78, wherein the upright pad support 82 may be substantially parallel to the straight portion of the vertical J-arm 78. A pad plate 86 may be attached to a distal end of the upright pad support 82 and a pad 88 may be operatively attached to a front surface of the pad plate 86, wherein each of the pad 88 and the pad plate 86 may be substantially planar and, for example, circular shaped.

Figure 10:
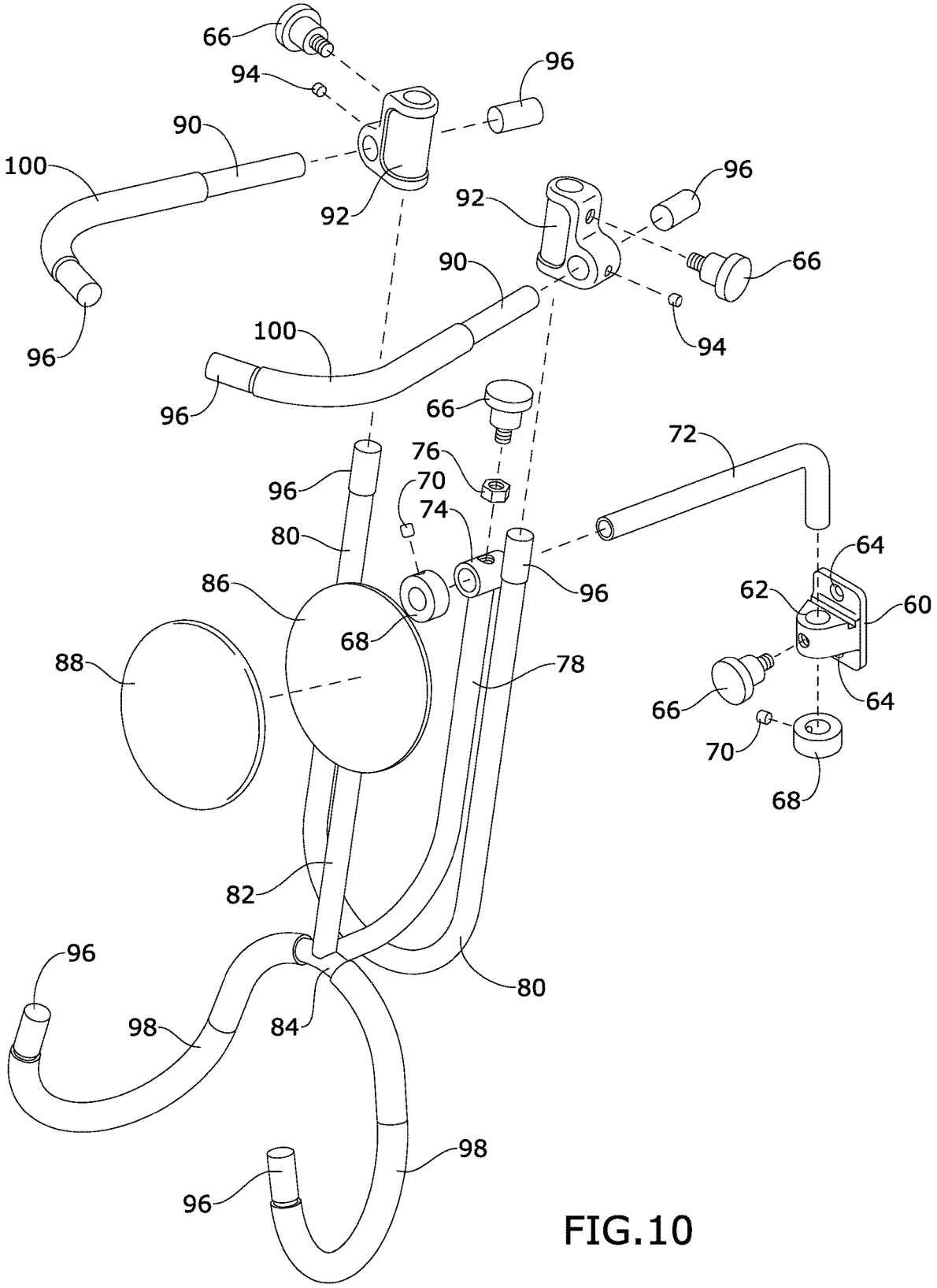
FIG. 10 depicts an exploded view of certain embodiments of the musical instrument support stand.

As shown in the Figures, the securement frame may be rotatably mounted to the wall 102 using a wall mount bracket 60. As shown in FIG. 10, the wall mount bracket 60 may comprise a plate, such as a planar plate, with a bracket slot extension 62 extending outward therefrom. The bracket slot extension 62 may include a bracket orifice extending therethrough, wherein the bracket orifice may be sized to accommodate insertion of a horizontal J-arm 72 therethrough.

Figure 11:
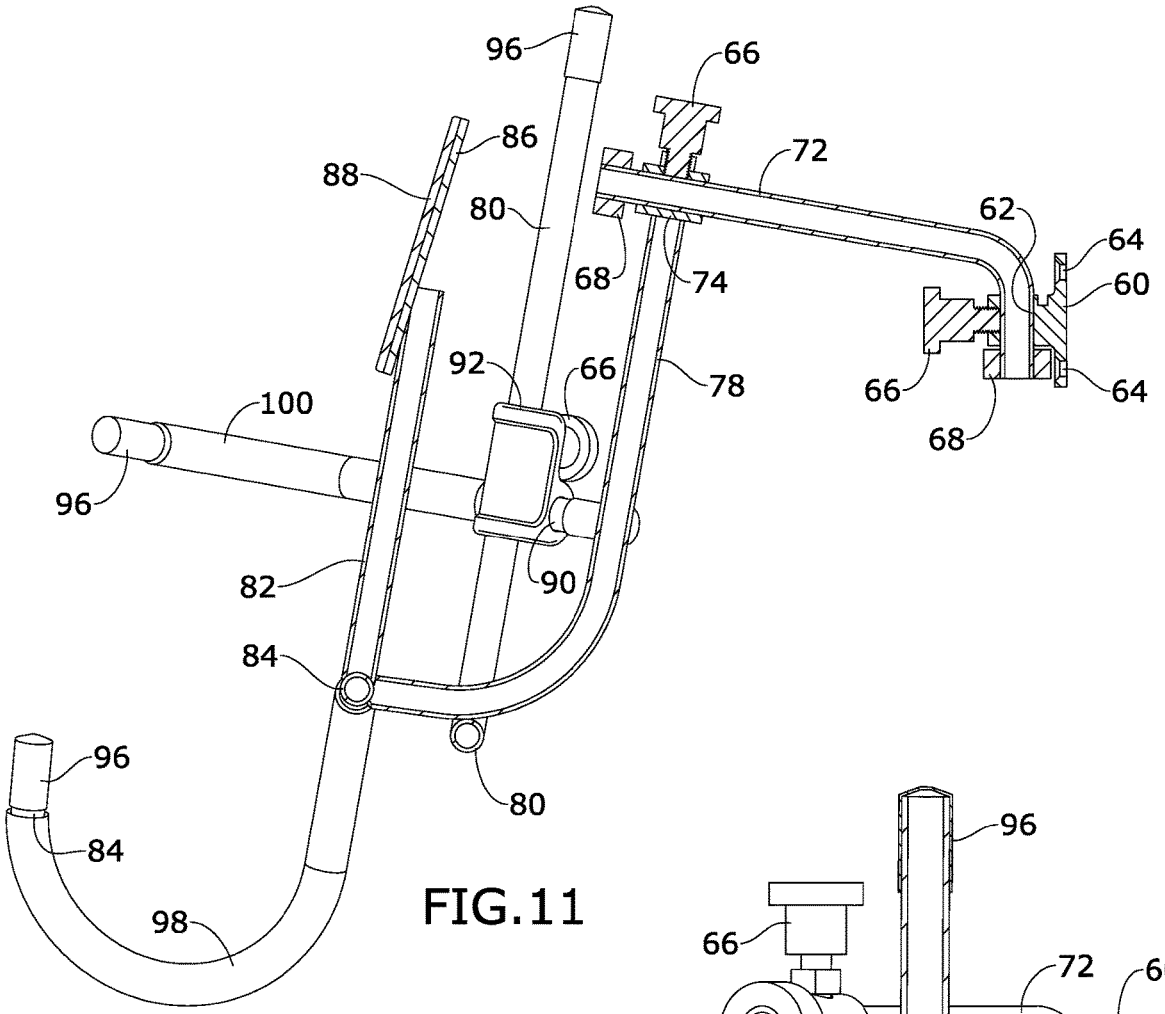
FIG. 11 depicts a section view of certain embodiments of the musical instrument support stand, taken along line 11-11 in FIG. 9.
Figure 12:
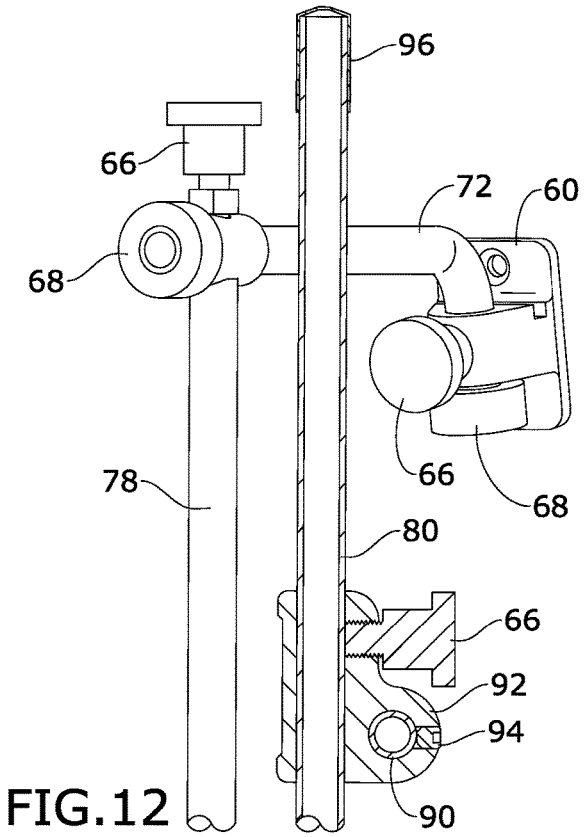
FIG. 12 depicts a section view of certain embodiments of the musical instrument support stand, taken along line 12-12 in FIG. 9.

In embodiments, and as depicted in FIGS. 10 and 11, a U-arm 80 may be coupled to vertical J-arm 78, wherein each upward extending half of the U-arm 80 may serve as a mounting location for one of the pair of side arms 90. Each upper end of the U-arm 80 halves may have an end cap 96 positioned thereon.

Figure 13:
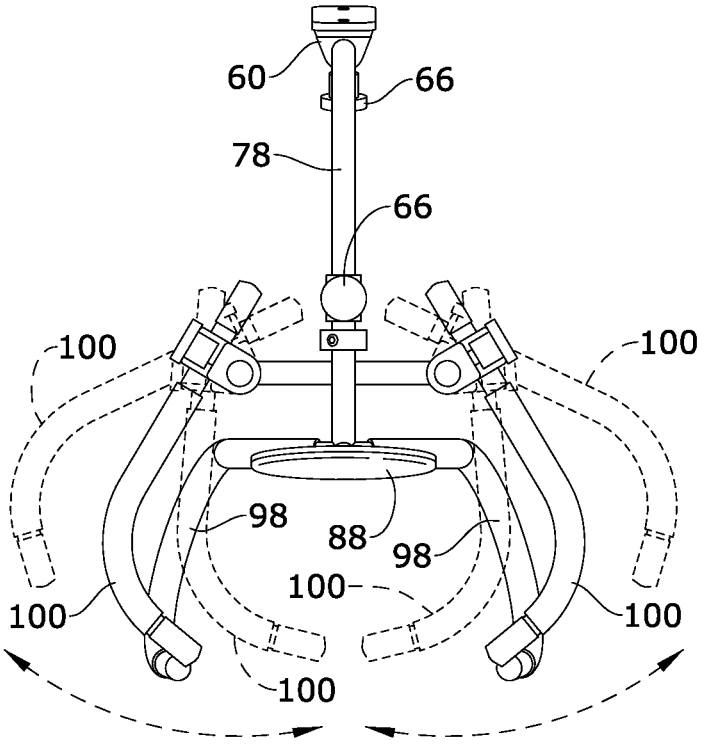
FIG. 13 depicts a top view of certain embodiments of the musical instrument support stand, illustrating horizontal adjustability of arms 90.
Figure 14:
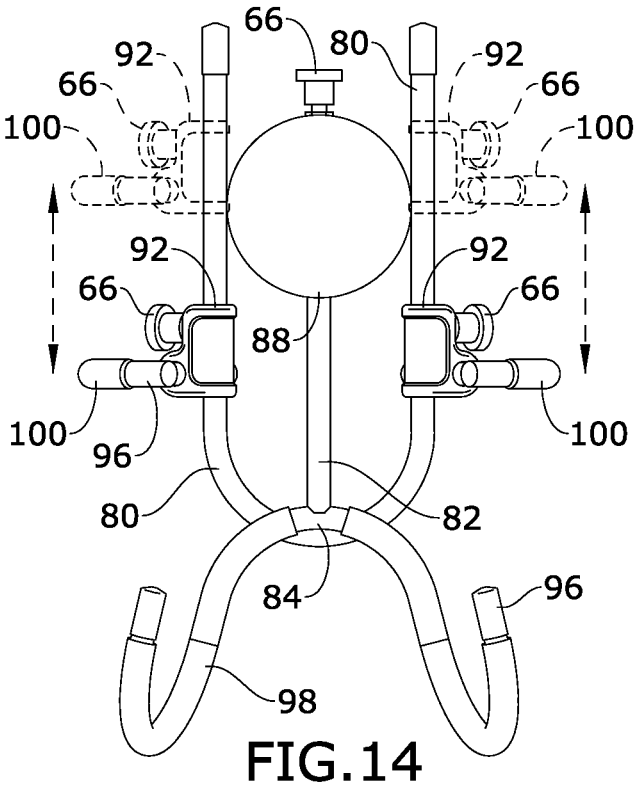
FIG. 14 depicts a front view of certain embodiments of the musical instrument support stand, illustrating vertical adjustability of arms 90.
Figure 15:
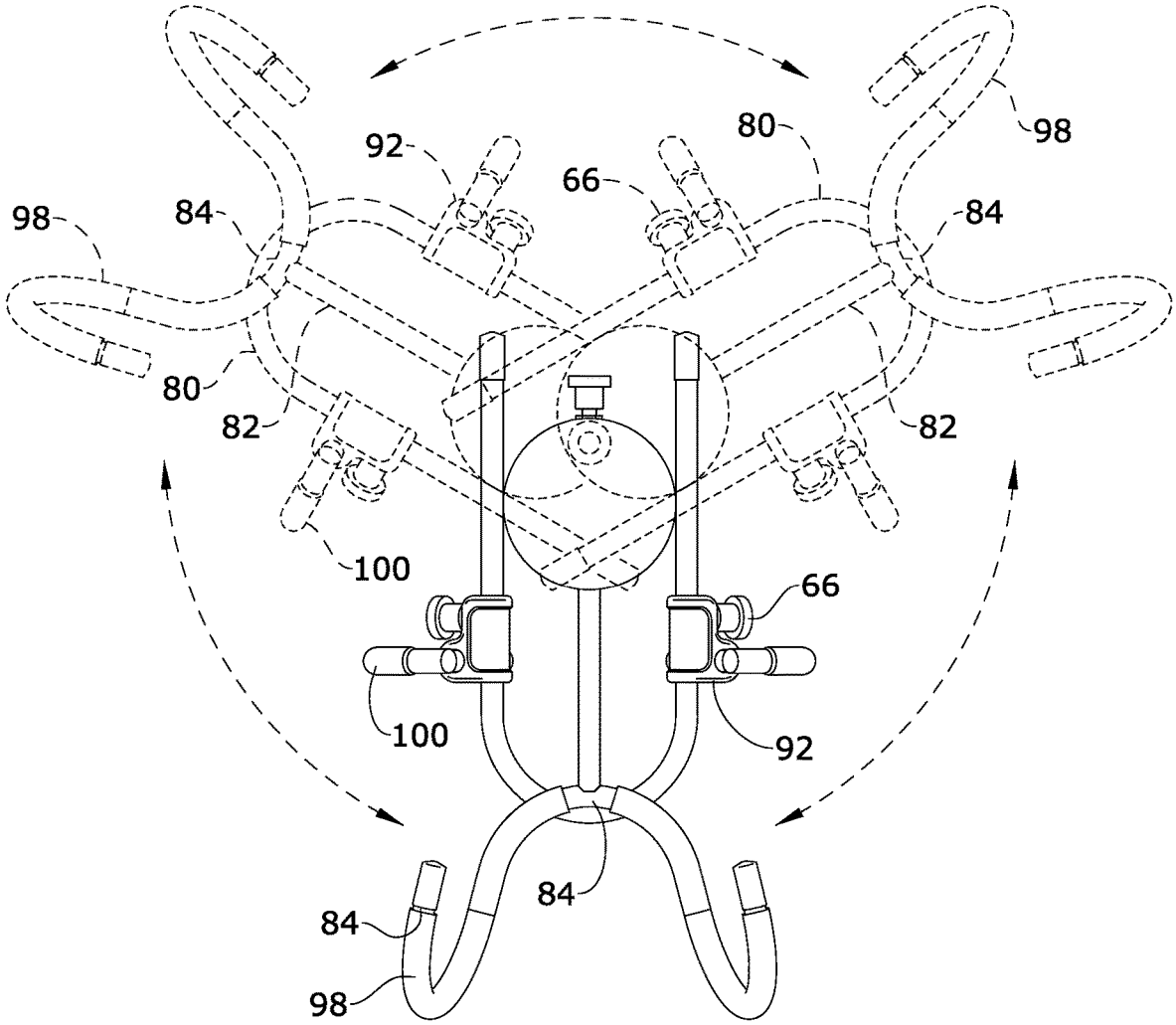
FIG. 15 depicts a front view of certain embodiments of the musical instrument support stand, illustration the rotation around arm 72.

As shown in FIG. 10, each upward extending half of the U-arm 80 may have an arm bracket 92 slidably engaged therewith, wherein each of the arm brackets 92 comprises a cylindrical body with a bracket arm extension protruding from a side surface thereof, wherein the bracket arm extension includes an arm orifice extending therethrough, the arm orifice being sized to accommodate passage of a proximal end of a side arm 90 therethrough. After the side arm 90 is inserted into and through the bracket arm extension, an end cap 96 may be placed onto the proximal end of the side arm 90 and a bracket set screw 94 may be inserted into the bracket arm extension to secure the side arm 90 at its desired rotational position. Thus, the side arm 90 may be able to pivot within the arm bracket 92, as desired, to achieve the desired rotation position, as shown in FIG. 13. Moreover, a thumb screw 66 or the like may be used to secure the arm bracket 92 onto the upward extending half of the U-arm 80 at the desired location. As shown in the Figures, the side arms may each have an elongate curved shape, wherein a sleeve 100 may be disposed onto each side arm 90, the sleeve 100 providing an additional padding layer to prevent or reduce the potential of damage to the instrument. A distal end of each side arm 90 may include an end cap 96 attached thereto.

In embodiments and as depicted in FIGS. 9-11, 14, and 15, lower cradle 84 may be coupled to vertical J-arm 78 and may comprise a pair of hooked members. The hooked members of the lower cradle 84 may be configured to contact and support the bottom of the body of guitar 40. In embodiments, each of the hooked members may include a lower hook sleeve 98 disposed thereon.

As mentioned above, pad 88 may be coupled to pad plate 86 and may comprise a material such as leather, rubber or other resilient and/or deformable material. As discussed above, a sleeve or padding material may be disposed around the pair of side arms 90, the lower cradle 84, and any other location on the support apparatus that contacts guitar 40. The padding material comprises a material such as leather, rubber or other resilient and/or deformable material.

Figure 8:
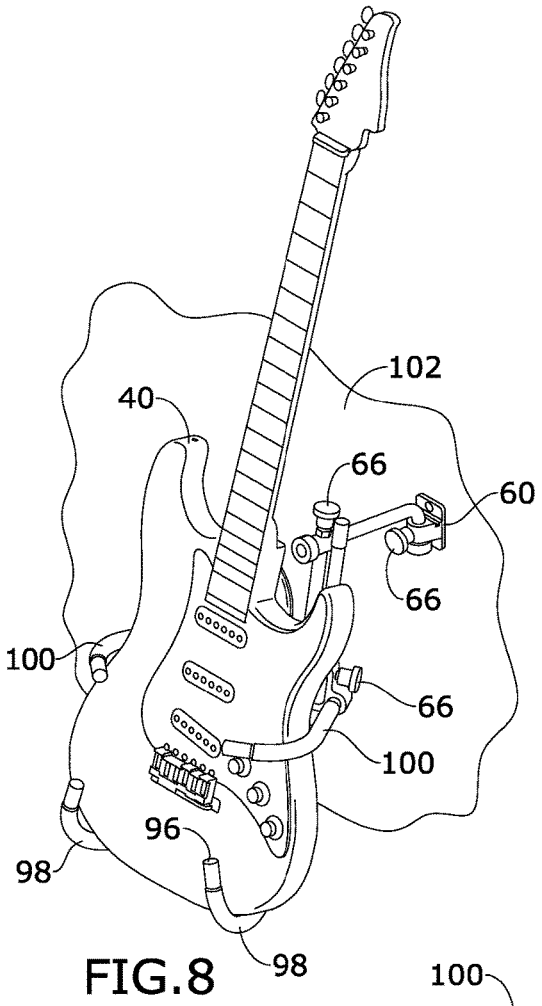
FIG. 8 depicts a perspective view of certain embodiments of the musical stand support apparatus shown in use illustrating the guitar secured in an upright angle.
Figure 9:
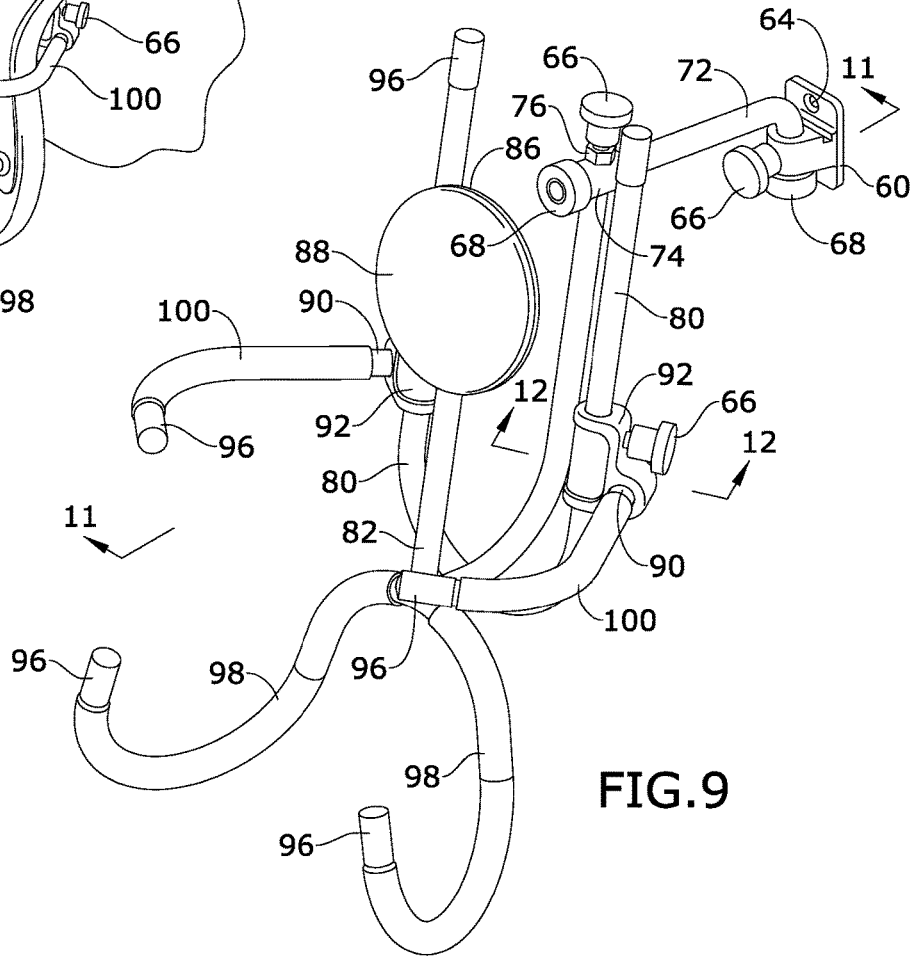
FIG. 9 depicts a perspective view of certain embodiments of the musical instrument support stand.

In operation, guitar 40 is secured to the support apparatus. In one embodiment as depicted in FIG. 8, guitar 40 is maneuvered so that the body is disposed against pad 88 and pad plate 86, and the bottom of the guitar body is disposed on lower cradle 84. The pair of side arms 90 may be pivotably adjusted and locked in place to contact the sides of the body of guitar 40.

In this position, guitar 40 is securely fastened within support apparatus. Thumb screw 66 that is engaged with the J-arm coupler 74 may be loosened to permit rotation of the securement apparatus at the junction of the vertical J-arm 82 and the horizontal J-arm 72, allowing the guitar 40 to rotate up to 360 degrees relative to the wall 102. When the desired rotational position is achieved, the thumb screw 66 may be reengaged with the J-arm coupler 74 to retain the guitar 40 in the desired position. Since guitar 40 is securely fastened to securement frame, guitar 40 will not detach from the support apparatus in any displayed position.

In embodiments, the components of the securement frame are preferably made from 1018 cold-rolled steel, unless otherwise specified. However, it is envisioned that the components may be made from other types of steel, metals, or materials. In fact, it shall be appreciated that the components of the stand support apparatus described in several embodiments herein may comprise any alternative known materials in the field and be of any color, size and/or dimensions. It shall be appreciated that the components of the stand support apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A musical instrument support apparatus with enhanced stability and a rotatable adjustment mechanism configured to display a guitar in one of a plurality of viewing positions, the guitar comprising a neck coupled to a body having a top, a bottom and a pair of sides, the support apparatus comprising:

a securement frame configured to be rotatably mounted to a vertical surface and comprising a plurality of bars connected together and a pad plate coupled to one of the plurality of bars;

a pair of side arms pivotably mounted to the securement frame, each arm in the pair of side arms configured to pivotably adjust to contact the body of the guitar; and a wall mount bracket attached to the securement frame and configured to be attached to the vertical surface, wherein the support apparatus is configured to secure the guitar with the body disposed on the support plate and the pair of sides of the body secured within the pair of arms, wherein the securement frame is rotatably adjusted relative to the support base to display the secured guitar in one of the plurality of viewing positions.

2. The support apparatus of claim 1, further comprising a lower cradle coupled to the securement frame and configured to support the bottom of the body of the guitar.

3. The support apparatus of claim 1, wherein the plurality of bars of the securement frame comprises:

a horizontal J-bar comprising a proximal end and a curved distal end;

a vertical J-bar comprising a vertical bar proximal end and a curved vertical bar distal end, the proximal end of the horizontal J-bar rotatably engaged with the vertical bar proximal end;

a lower cradle attached to the vertical bar distal end.

4. The support apparatus of claim 3, wherein: the vertical bar proximal end has a J-arm coupler fixedly attached thereto; and the J-arm coupler is substantially cylindrical and sized to accommodate insertion of the proximal end of the horizontal J-arm therein.

5. The support apparatus of claim 3, further comprising an upright pad support extending upward from the vertical bar distal end, wherein the pad plate is attached to a distal end of the upright pad support.

6. The support apparatus of claim 3, further comprising a U-arm coupled to the vertical J-arm, wherein each side arm of the pair of side arms is pivotably mounted to an upward extending half of the U-arm.

7. The support apparatus of claim 3, further comprising a lower cradle attached to the vertical bar distal end.

* * * * *